US005387258A

United States Patent [19]

Puricelli

[11] Patent Number: 5,387,258

[45] Date of Patent: Feb. 7, 1995

[54] SELF-CLEANING OVEN

[75] Inventor: Orio Puricelli, Gallarate, Italy

[73] Assignee: Fulgor S.P.A., Callarate, Italy

[21] Appl. No.: 119,907

[22] Filed: Sep. 10, 1993

Related U.S. Application Data

[63] Continuation-in-part of Ser. No. 990,448, Dec. 15, 1992, abandoned.

[30] Foreign Application Priority Data

Dec. 30, 1991 [IT] Italy ..... MI91U001135

[51] Int. Cl.[6] ..... F24C 15/32; A21B 1/00

[52] U.S. Cl. ..... 126/21 A; 126/21 R; 126/198; 126/200; 219/393; 219/400

[58] Field of Search ..... 126/21 R, 21 A, 190, 126/198, 273 R, 200, 193; 219/391, 393, 400; 52/616, 304

[56] References Cited

U.S. PATENT DOCUMENTS

| | | | |
|---|---|---|---|
| 2,337,349 | 12/1943 | Rees | 126/21 R |
| 3,692,015 | 9/1972 | Chase et al. | 126/200 |
| 3,889,100 | 6/1975 | Dills | 126/200 |
| 3,911,893 | 10/1975 | Baker et al. | 126/21 A |
| 4,014,312 | 3/1977 | McKelvey et al. | 126/198 |
| 4,206,338 | 6/1980 | Katona | 126/21 R |
| 4,253,286 | 3/1981 | Katona | 126/198 |
| 4,331,124 | 5/1982 | Seidel | 126/21 R |
| 4,601,279 | 7/1986 | Guerin | 126/21 R |
| 4,606,324 | 8/1986 | Katona | 126/200 |
| 4,865,010 | 9/1989 | Kett | 126/21 R |

FOREIGN PATENT DOCUMENTS

| | | | |
|---|---|---|---|
| 010829 | 5/1980 | European Pat. Off. . | |
| 2352961 | 4/1975 | Germany | 126/21 A |
| 2545531 | 4/1977 | Germany . | |
| 8912976 | 3/1991 | Germany . | |
| 678913 | 11/1991 | Switzerland . | |

*Primary Examiner*—James C. Yeung
*Attorney, Agent, or Firm*—Wolf, Greenfield & Sacks

[57] ABSTRACT

Self-cleaning oven including a cooking compartment, a hinged door and a venting assembly. The venting assembly includes a fan connected to an aspiration duct which is in turn connected to an interspace provided in the door. The fan is also connected to a venting duct arranged parallel to the aspiration duct and has an outlet arranged above the door. The interspace of the door has an inlet for drawing air from the outside, and an outlet connected to the aspiration duct. The fan is adapted to draw air from the outside, through the interspace, and to discharge the air through said outlet of the venting duct. A venting device is provided connecting the cooking compartment to the venting duct and an auxiliary venting duct is provided inside the venting duct, at the venting device. A tray is provided at the end of the auxiliary venting device to prevent moisture from being discharged at the venting duct outlet in the form of water.

6 Claims, 4 Drawing Sheets

SELF-CLEANING OVEN

This application is a continuation-in-part of application Ser. No. 07/990,448, filed Dec. 15, 1992, abandoned.

BACKGROUND OF THE INVENTION

1. Field of the Invention

The present invention relates to a self-cleaning oven with improved venting system.

2. Description of the Prior Art

The outer surface of the doors of self-cleaning ovens must be kept at a sufficiently low temperature even when the oven operates at its maximum temperature, for example during the self-cleaning operation.

Generally, the oven doors have an interspace between the outermost panel, the one which may be touched by the user, and an internal panel. An aspirator, normally located in the upper part of the oven, is connected to the interspace, which is in turn connected to the outside by means of lower openings in order to generate a circulation of cold air, drawn from the outside, in the interspace, thus keeping the external panel at a temperature which is substantially lower than that of the internal panel which is closest to the cooking compartment.

Conventional doors have the disadvantage of having a considerable size: for an effective elimination of the heat it is in fact necessary to provide a relatively large interspace.

Furthermore, in the conventional venting systems the hot air is discharged either at the back of the oven cabinet or in the front.

U.S. Pat. No. 3,889,100, for example, discloses a venting system wherein air is drawn up through the door by means of a suction fan and discharged through an exhaust vent provided either at the top or back wall of the oven cabinet. It is evidently necessary to provide a space either at the back or above the oven for allowing the air to be discharged and it is a considerable disadvantage when the oven has to be included in the kitchen furniture.

Other ovens are provided with the air outlet at the front of the cabinet, above the door. For example, U.S. Pat. No. 3,692,015 discloses such an arrangement. Such an arrangement has a considerable disadvantage: the outlet is in fact close to the door handle which may become very hot and when the discharged air contains moisture, water drips on the handle and on the outer panel of the door.

The principal object of the present invention is to provide an improved venting system for household ovens.

Another aim of the present invention is to provide an oven having reduced dimensions compared to conventional ovens of similar capacity.

A further object of the invention is to provide an oven which can be easily included in the kitchen furniture.

SUMMARY OF THE INVENTION

This aim, these objects and others which will become apparent hereinafter are achieved by an oven as claimed in the accompanying claims.

Further characteristics and advantages of the invention will become apparent from a reading of the detailed description of a preferred but not exclusive embodiment of an oven door according to the invention, illustrated only by way of a non-limiting example in the accompanying drawings.

DESCRIPTION OF THE PREFERRED EMBODIMENTS OF THE INVENTION

Figure 1:
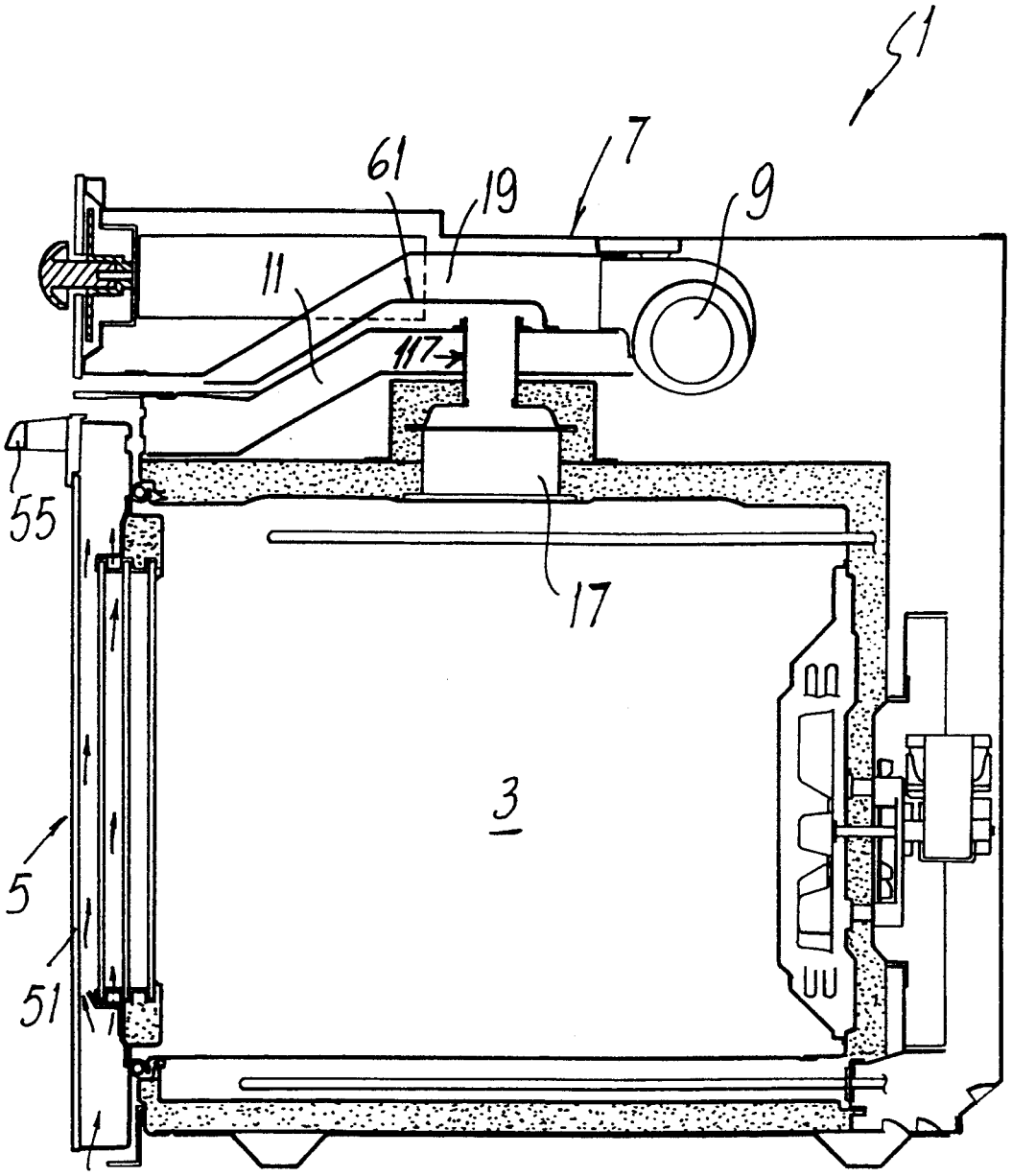
FIG. 1 is a side sectional view, taken along a median plane, of an oven according to the invention.

With reference to the above figures, a household oven, of the pyrolytic type, generally designated by the reference numeral 1, has a cooking compartment 3 and a hinged door 5.

A venting assembly 7 comprises a fan 9 connected to the upper part of the door 5 by means of an aspiration duct 11. The fan 9 is also connected to a venting duct 19 for discharging the hot air.

The duct 11 has a first series of lower openings 13 and a second series of upper openings 15 which are formed on the front edge of the oven at the door 5 and are connected thereto as described hereinafter.

A venting device 117 for expelling the combustion residues generated during the self-cleaning operation of the oven, comprises a catalytic element 17 through which the residues pass before they are expelled from the cooking compartment by means of the auxiliary venting duct 61.

Figure 4:
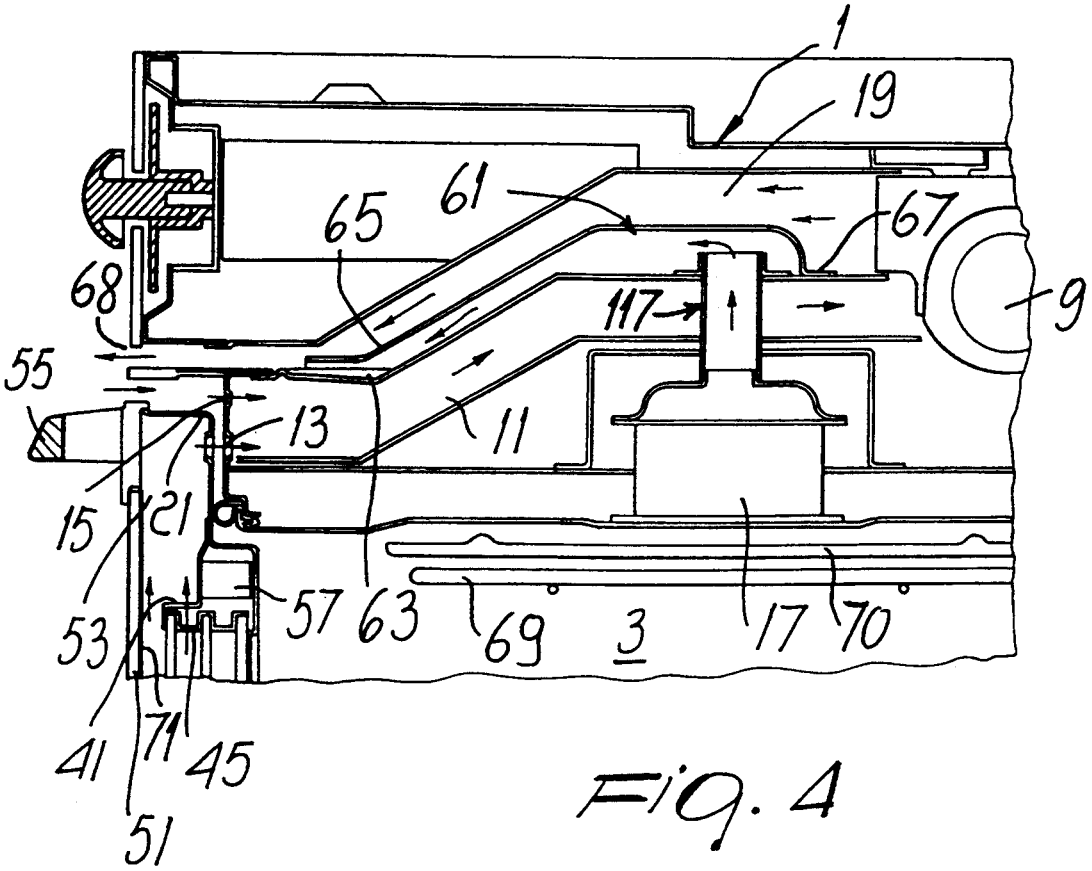
FIG. 4 is a side sectional detail view of the upper portion of the oven.

As illustrated in FIG. 4, a heat reflector 70 is provided at the upper portion of the cooking compartment, between the venting device 117 and a heating member 69, in order to improve insulation between the cooking compartment and the venting system.

Figure 5:
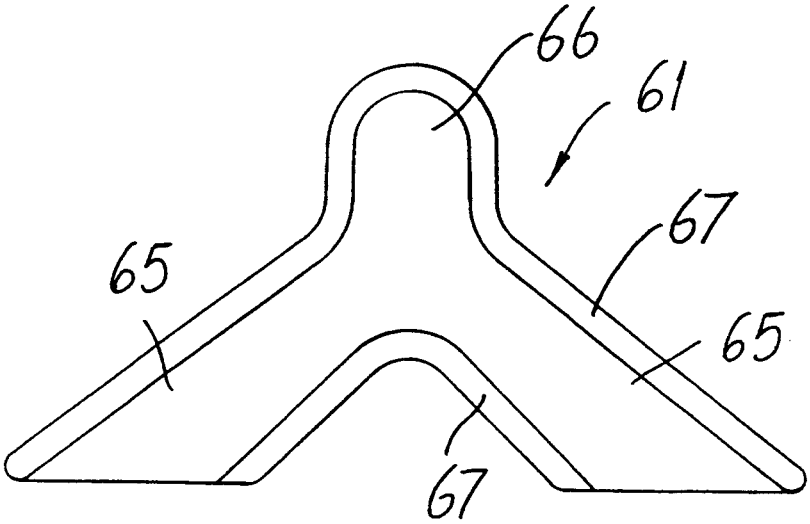
FIG. 5 is a top view of the auxiliary venting duct.

The auxiliary venting duct 61 is substantially V shaped, as illustrated in FIG. 5, comprising two branches 65, connected to a manifold 66, and a flange 67.

The auxiliary venting duct 61 is arranged inside the venting duct 19, as better illustrated in FIG. 4, the manifold 66 being arranged at the venting device 117.

At each of the ends of the branches 65, a tray or cup 63 is formed in the base of the venting duct 19. Since the air flowing in the aspiration duct 11 is at a considerably lower temperature than the air flowing in the auxiliary duct 61, the moisture, possibly present in the air discharged through the auxiliary venting duct, condenses on the lower surface of the auxiliary duct 61 and is collected in the trays 63.

The hot air is discharged from the opening 68 located above the handle 55 of the hinged door, however, because of the V-shaped construction of the auxiliary venting duct 61, the air is discharged mostly at the sides. In this manner the center portion of the door handle, where generally the user places his/her hand for opening the door, remains at a lower temperature.

The door 5 comprises a frame 21 which is centrally open and is adapted to support a first series of internal panels 23 and an external panel 25. As customary in household ovens, the panels are made of transparent material in order to allow visual inspection of the cooking compartment without having to open the door.

The series of internal panels comprises, starting from the side directed toward the compartment 3: a first panel 27 and a second panel 29, separated by a first interspace 31, and a third panel 33 separated from the second panel by a second interspace 35.

The panels 27, 29 and 33 are fixed to one another and to the frame 21 by means of metal sections 37. The metal sections have openings 39 at the second interspace 35. Openings 39 are adapted to connect the interspace to the outside. The first interspace 31 is instead isolated.

The lower and upper edges of the third panel 33 are also respectively associated with an upper fastening member 41 and with a lower fastening member 43 which cooperate to fasten the third panel and have openings 45 for the passage of air. The fastening members 41 and 43 are constituted by metal sections and have a heat-reflecting surface directed toward the compartment 3 so as to constitute a screen which reflects the heat inward.

At the lower edge of the third panel there is also a baffle 47 which substantially embraces the section 43 and is adapted to direct the flow of air which arrives from below toward the outermost panel. The baffle 47 is also provided with openings 49 for the passage of the air in the interspace 35.

Door 5 has a fourth panel 51 which is fixed to the outside of the frame 21 so as to define a third interspace 53 with the third panel 33. The third interspace 53 is connected to the outside in a downward position by means of openings (not shown) formed along the lower edge of the frame. In an upward position, the third interspace is connected both to the outside, at the handle 55, and to the openings 13 of the aspiration duct 11.

Figure 2:
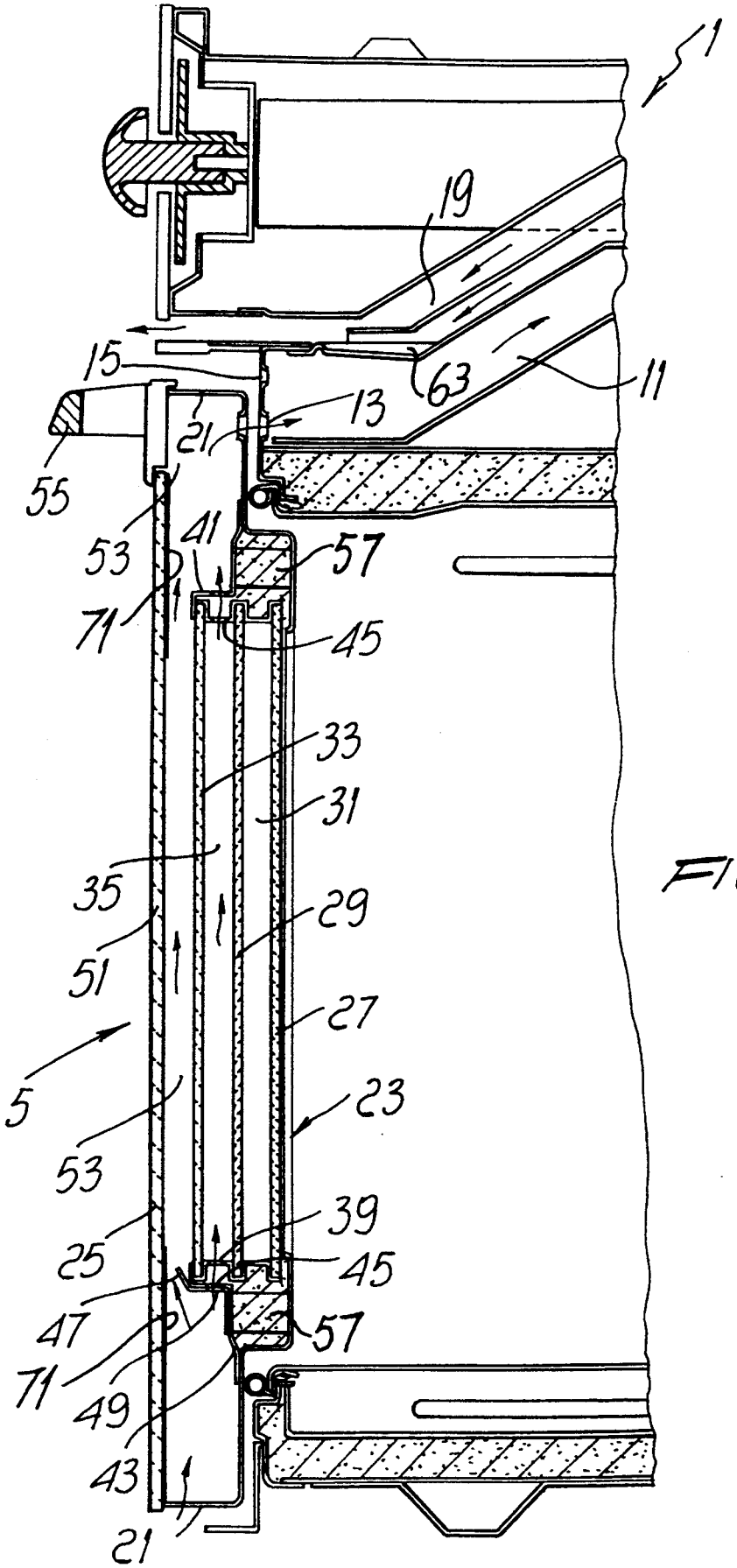
FIG. 2 is a side sectional detail view of the door, taken along a median plane.
Figure 3:
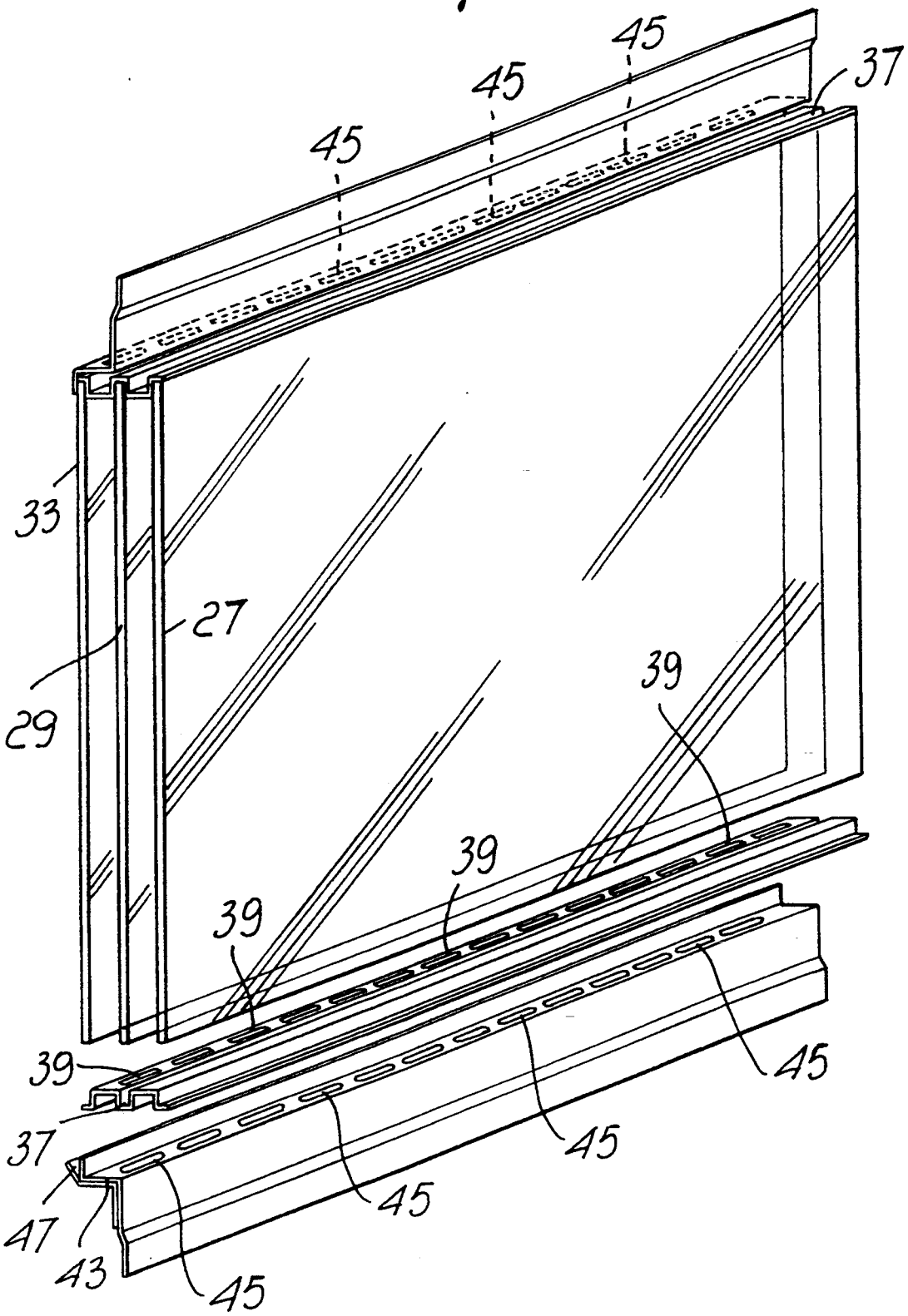
FIG. 3 is an exploded perspective view of a portion of the door.

A reflecting foil frame 71 is provided on the inner surface of the fourth panel 51, as illustrated in FIG. 2. The foil frame 71 is made of aluminum or any other suitable material adapted to reflect heat.

The operation of the oven according to the invention is as follows. The fan 9 generates a negative pressure in the duct 11 and thus in the third interspace 53; outside air therefore enters both from the lower side of the door and through the handle 55, generating a current through the second and third interspaces.

The outward air flow generated by the fan 9 in the duct 19 also draws air from the auxiliary duct 61 and the hot air coming from inside the oven compartment is discharged at the sides of the outlet 68.

In this manner, the outer surface of the panel 51 and the handle 55 are always at sufficiently low temperature.

Advantageously, insulating material 57 is also arranged in the region comprised between the frame 21 and the fixing elements 41 and 43.

In practice it has been observed that the invention achieves the intended aim and objects, providing a cold door structure for household ovens which has a considerably reduced bulk.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended as limiting. The invention is limited only as defined in the following claims and the equivalents thereto.

What I claim is:

1. A self-cleaning oven comprising a cooking compartment, a hinged door and a venting assembly, said venting assembly having a fan connected to an aspiration duct, said aspiration duct being connected to an interspace provided in said door, said fan being also connected to a venting duct arranged parallel to said aspiration duct and having an outlet arranged above said door, said interspace of said door having an inlet for drawing air from the outside, and an outlet connected to said aspiration duct, said fan being adapted to draw air from the outside through said interspace and to discharge said air through said outlet of said venting duct;

said self-cleaning oven further comprising a venting device connecting said cooking compartment to said venting assembly, said venting assembly also having an auxiliary venting duct coupled to said venting device inside said venting duct, and means for preventing moisture from being discharged at said venting duct outlet in the form of water; and wherein said auxiliary venting duct is substantially V shaped and comprises two branches connected to a manifold, said manifold being coupled to said venting device, each of said branches having an end, each said end associated with a tray formed in said venting duct, so as to prevent moisture from being discharged at said venting duct outlet in the form of water.

2. A self-cleaning oven comprising a cooking compartment, a hinged door and a venting assembly, said venting assembly having a fan connected to an aspiration duct, said aspiration duct being connected to an interspace provided in said door, said fan being also connected to a venting duct arranged parallel to said aspiration duct and having an outlet arranged above said door, said interspace of said door having an inlet for drawing air from the outside, and an outlet connected to said aspiration duct, said fan being adapted to draw air from the outside through said interspace and to discharge said air through said outlet of said venting duct;

said self-cleaning oven further comprising a venting device connecting said cooking compartment to said venting assembly, said venting assembly also having an auxiliary venting duct coupled to said venting device inside said venting duct, and means for preventing moisture from being discharged at said venting duct outlet in the form of water;

wherein said hinged door has aframe comprising, from said oven compartment toward the outside, a first panel and a second panel, said first and second panels being separated by a first interspace, a third panel separated from said second panel by a second interspace, and a fourth external panel separated from said third panel by a third interspace, said second and third interspaces being connected to said aspiration duct; and wherein a reflecting foil frame is provided on the inner surface of said fourth panel.

3. A self-cleaning oven comprising a cooking compartment, a hinged door and a venting assembly, said venting assembly having a fan connected to an aspiration duct, said aspiration duct being connected to an interspace provided in said door, said fan being also connected to a venting duct arranged parallel to said aspiration duct and having an outlet arranged above said door, said interspace of said door having an inlet for drawing air from the outside, and an outlet connected to said aspiration duct, said fan being adapted to draw air from the outside through said interspace and to discharge said air through said outlet of said venting duct;

said self-cleaning oven further comprising a venting device connecting said cooking compartment to said venting assembly, said venting assembly also having an auxiliary venting duct coupled to said venting device inside said venting duct, and means for preventing moisture from being discharged at said venting duct outlet in the form of water;

wherein said hinged door has frame comprising, from said oven compartment toward the outside, a first panel and a second panel, said first and second panels being separated by a first interspace, a third panel separated from said second panel by a second interspace, and a fourth external panel separated from said third panel by a third interspace, said second and third interspaces being connected to said aspiration duct;

wherein said third panel is associated with said door by means of an upper fastening member and a lower fastening member, said fastening members being perforated so as to allow the flow of air from outside toward the inside of said second interspace and from said second interspace toward said aspiration means; and wherein each of said fastening members constitutes a screen having a reflecting surface directed toward the inside of said cookong compartment.

4. A self-cleaning oven, comprising:

a cooking compartment having a top portion and a base portion;

a door including an upper portion, a lower portion, and an interspace, said lower portion hingedly attached to said base portion, said interspace having a lower inlet in said lower portion for accepting air from the outside, and an upper outlet in said upper portion;

a fan, mounted above and proximate to said top portion of said cooking compartment, said fan having an inlet and an outlet;

an aspiration duct including an outlet connected to said inlet of said fan and an inlet facing said upper outlet of said door when said door is closed;

a venting duct, above said aspiration duct, including an inlet connected to said outlet of said fan and an outlet located above and proximate to said inlet of said aspiration duct;

a venting device including an inlet portion within said cooking compartment and an outlet portion; and an auxiliary venting duct within said venting duct, said auxiliary duct having an inlet in fluid communication with said outlet portion of said venting device, and an outlet providing fluid conduit into said venting duct;

said auxiliary venting duct further including an inlet manifold, and two branches connected to said manifold, said branches each having an outlet end, said venting duct having a formed tray below each said outlet end, so as to prevent moisture from being discharged at said venting duct outlet in the form of water.

5. A self-cleaning oven, comprising:

a cooking compartment having a top portion and a base portion;

a door including an upper portion, a lower portion, and an interspace, said lower portion hingedly attached to said base portion, said interspace having a lower inlet in said lower portion for accepting air from the outside, and an upper outlet in said upper portion;

a fan, mounted above and proximate to said top portion of said cooking compartment, said fan having an inlet and an outlet;

an aspiration duct including an outlet connected to said inlet of said fan and an inlet facing said upper outlet of said door when said door is closed;

a venting duct, above said aspiration duct, including an inlet connected to said outlet of said fan and an outlet located above and proximate to said inlet of said aspiration duct;

a venting device including an inlet portion within said cooking compartment and an outlet portion; and an auxiliary venting duct within said venting duct, said auxiliary duct having an inlet in fluid communication with said outlet portion of said venting device, and an outlet providing fluid conduit into said venting duct;

wherein said door further includes a frame, and said frame includes, from said oven compartment toward the outside, a first panel and a second panel, said first panel and said second panel separated by a first interspace, a third panel separated from said second panel by a second interspace, and a fourth external panel separated from said third panel by a third interspace, said second and third interspaces in fluid communication with said inlet of said fan; and wherein said fourth panel includes a reflecting foil frame.

6. A self-cleaning oven, comprising:

a cooking compartment having a top portion and a base portion;

a door including an upper portion, a lower portion, and an interspace, said lower portion hingedly attached to said base portion, said interspace having a lower inlet in said lower portion for accepting air from the outside, and an upper outlet in said upper portion;

a fan, mounted above and proximate to said top portion of said cooking compartment, said fan having an inlet and an outlet;

an aspiration duct including an outlet connected to said inlet of said fan and an inlet facing said upper outlet of said door when said door is closed;

a venting duct, above said aspiration duct, including an inlet connected to said outlet of said fan and an outlet located above and proximate to said inlet of said aspiration duct;

a venting device including an inlet portion within said cooking compartment and an outlet portion; and an auxiliary venting duct within said venting duct, said auxiliary duct having an inlet in fluid communication with said outlet portion of said venting device, and an outlet providing fluid conduit into said venting duct;

wherein said door further includes a frame, and said frame includes, from said oven compartment toward the outside, a first panel and a second panel, said first panel and said second panel separated by a first interspace, a third panel separated from said second panel by a second interspace, and a fourth external panel separated from said third panel by a third interspace, said second and third interspaces in fluid communication with said inlet of said fan;

wherein said third panel is attached to said door by an upper fastening member and a lower fastening member, said fastening members being perforated so as to allow the flow of air from outside toward the inside of said second interspace and from said second interspace toward said aspiration means; and wherein each of said fastening members includes a reflecting surface directed toward the inside of said cooking compartment.

* * * * *